United States Patent [19]

Takami et al.

[11] 4,060,661

[45] Nov. 29, 1977

[54] VOLTAGE-DEPENDENT RESISTOR

[75] Inventors: Akihiro Takami, Katano; Takayuki Kuroda, Nishinomiya; Katsuo Nagano, Chitose; Michio Matsuoka, Ibaraki, all of Japan

[73] Assignee: Matsushita Electric Industrial Co., Ltd., Osaka, Japan

[21] Appl. No.: 711,639

[22] Filed: Aug. 4, 1976

[30] Foreign Application Priority Data

| | | |
|---|---|---|
| Aug. 22, 1975 | Japan | 50-102442 |
| Aug. 22, 1975 | Japan | 50-102444 |
| Aug. 22, 1975 | Japan | 50-102445 |
| Aug. 22, 1975 | Japan | 50-102446 |
| Aug. 22, 1975 | Japan | 50-102447 |
| Aug. 22, 1975 | Japan | 50-102448 |

[51] Int. Cl.[2] ..... H01B 1/02; H01B 1/08

[52] U.S. Cl. ..... 428/432; 427/101; 252/514; 252/518; 252/519

[58] Field of Search ..... 252/514, 518.3, 519; 428/426, 432; 427/101

[56] References Cited

U.S. PATENT DOCUMENTS

| | | | |
|---|---|---|---|
| 2,633,521 | 3/1953 | Becker et al. | 252/519 X |
| 3,766,098 | 10/1973 | Masuyama et al. | 252/519 |
| 3,905,006 | 9/1975 | Matsuoka et al. | 252/518.3 |
| 3,938,069 | 2/1976 | May | 252/518.3 |

*Primary Examiner*—Benjamin R. Padgett
*Assistant Examiner*—E. Suzanne Parr
*Attorney, Agent, or Firm*—Cushman, Darby & Cushman

[57] ABSTRACT

There is provided a voltage-dependent resistor comprising a bulk consisting essentially of zinc oxide as the major part and as additives 0.01 to 10 mol % of $Bi_2O_3$, CoO, MnO, TiO and NiO and electrodes on the bulk, said electrodes having been formed by baking a silver paste comprising silver powder and a glass frit on the bulk, said glass frit containing as its principal content 80 to 95% by weight of $Bi_2O_3$ and correspondingly 20 to 5% by weight of $SiO_2$, said glass frit also containing 1 to 5 parts by weight of $B_2O_3$ for 100 parts of said principal content. The electrodes can also contain minor amounts of CoO, $Sb_2O_3$, a mixture of $Sb_2O_3$ with $Ag_2O$ or MgO, or a mixture of CoO with MgO or $Ag_2O$.

16 Claims, 31 Drawing Figures

VOLTAGE-DEPENDENT RESISTOR

BACKGROUND OF THE INVENTION

This invention relates to a voltage-dependent resistor suitable as surge-absorbing element.

Voltage-dependent resistors, namely varistors, have been widely used for voltage stabilizing and surge absorbing. The electrical characteristics of such a non-linear resistor are expressed by the relation:

$$I = (V/C)^{\alpha},$$

where $V$ is the voltage across the resistor, $I$ is the current flowing through the resistor, $C$ is a constant. It is ordinary desirable that the value of varistor non-linear exponent (hereinafter referred to as exponent ) $\alpha$ be as large as possible since this exponent determines the extent to which the resistors depart from ohmic characteristic.

For such voltage dependent resistor, varistors of silicon carbide type, which utilize voltage sensitivity of contact resistance of silicon carbide grains, have been widely used. This device has the merit of cheap in cost, but their varistor non-linear exponent $\alpha$ is so low as 3 to 7, and accordingly, effects in voltage stabilization or surge absorbing are not satisfactory.

For varistors having larger values of exponent $\alpha$, the varistors containing mainly zinc oxide have been recently developed and put into practical use. The zinc oxide type varistor is made by mixing ZnO small amounts of $Bi_2O_3$, PbO and BaO together, moulding in a cast and fired in the air at temperature of 1000° C to 1500° C. The non-linear voltage-current characteristic is produced by the interfaces mainly consisting of additives surrounding sinterred grains mainly consisting of zinc oxide, and the exponent $\alpha$ of above 50 is obtainable. In the conventional varistors wherein their electrodes are formed by sputtering aluminum and copper on both principal faces of the varistor bulk, though the exponent $\alpha$ are great, the varistor voltages across their terminals are easily deteriolated by D.C. loading.

In order to improve the D.C. loading life, for the method of forming electrodes on the varistor bulk, a method of applying glass-containing slurry on the varistor bulk and baking and thereafter sputtering Al and Cu, or another method of applying a silver paint containing glass-frit and silver powder on the varistor bulk and baking it has been used. Varistors produced by the abovementioned way shows satisfactory characteristic for voltage stabilizer and are widely used. (e.g. U.S. Pat. 3,962,144).

Recently, the abovementioned zinc oxide type varistors are found to have satisfactory characteristic also for surge absorbing and they become widely used for surge absorbing use.

The abovementioned conventional electrodes for the zinc oxide varistors have been developed and suitable for the use as the voltage stabilizer of high exponent values and durabilities in static D.C. use, but they have contained over 10% by weight of $B_2O_3$ and hence have not been suitable for the surge absorbing use. Such high amount of $B_2O_3$ is considered as the cause of the hard deterioration of the varistor voltage after impulse current test.

For a surge absorbing element, a characteristic that the deterioration rate of varistor voltage (across its electrodes) should be small even after applications of impulse current or surge current is required.

Also for the index of indicating high capability of the surge absorbing, the ratio $V_{10A}/V_{1mA}$ of the voltage $V_{10A}$ corresponding to the varistor current of 10A to the voltage $V_{1mA}$ corresponding to the varistor current of 1mA is observed, by using surge currents of special waveform wherein duration of wave-front is 8 microseconds and duration of wave-front tail-length is 20 microseconds (such wave is hereinafter referred to as 8 $\times$ 20 $\mu$s). The ratio $V_{10A}/V_{1mA}$ is called "voltage clamping ratio", and the closer to 1 the clamping ratio is, to the extent of the larger current the non-linear characteristic of the varistor exists, hence the better surge absorbing ability the varistor has. In the conventional varistor for the voltage regulation purpose, the clamping ratio has been about 3.

Furthermore, the varistor of the surge absorbing purpose must be stable also for stationary D.C. or A.C. operation.

SUMMARY OF THE INVENTION

This invention relates to a varistor suitable for surge-absorbing purpose.

More particularly, this invention concerns a zinc oxide type varistor for the surge-absorbing purpose provided with an improved electrodes for attaining improved durability against repetions of large impulsive surge currents.

BRIEF EXPLANATION OF DRAWING

FIG. 1 to FIG. 31 are graphs showing characteristics of the examples of the present invention, wherein:

FIGS. 1 to 3 are for Example 1,
FIGS. 4 to 7 are for Example 2,
FIGS. 8 to 11 are for Example 3,
FIGS. 12 to 16 are of Example 4,
FIGS. 17 to 21 are for Example 5,
FIGS. 22 to 26 are for Example 6,
FIGS. 27 to 31 are for Example 7, and FIGS. 1, 4, 8, 12, 17, 22 and 27 show relation between the amount of $B_2O_3$ and the exponent $\alpha$, FIGS. 2, 5, 9, 13, 18, 23 and 28 show relation between the amount of $B_2O_3$ and the rate of deterioration of the voltage across the electrode after a test by large current impulses, FIGS. 3, 7, 11, 16, 21, 26 and 31 show relation between the lapse time with A.C. load current and the deterioration rate of the voltage across the electrode, FIGS. 6, 24 and 29 show relation between the amount of CoO and the voltage clamping ratio, FIGS. 10, 14 and 19 show relation between the amount of $Sb_2O_3$ and the voltage clamping ratio, FIGS. 15 and 30 show relation between the amount of $Ag_2O$ and the deterioration rate and FIGS. 20 and 25 show relation between the amount of MgO and the deterioration rate after a test by many surge currents.

DETAILED DISCLOSURE OF THE INVENTION

Figure 1:
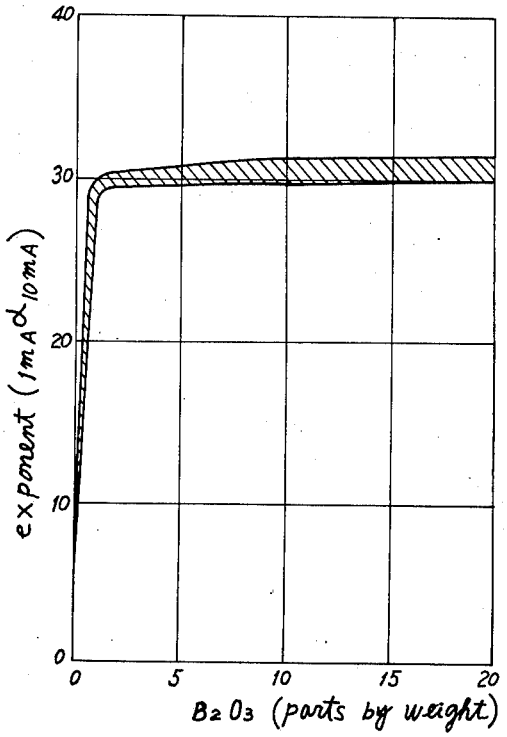

The voltage-dependent resistor of the present invention comprizes a bulk mainly consisting of zinc oxide and electrodes formed on specified parts thereof by applying a silver paste prepared by mixing silver powder, synthetic resin, solvent and glass frit which is prepared by mixing 80 to 95% by weight of $Bi_2O_3$ and 5 to 20% by weight of $SiO_2$, adding 1 to 5 parts by weight of $B_2O_3$ to 100 parts by weight of said mixture, further mixing the above, fired and pulverized. It is empirically found that inorganic contents of the silver paste is retained substantially unchanged even after baking thereof. It is also empirically found that even when the amount of the silver varies from 200 parts to 800 parts by weight to 100 parts by weight of said glass frit, various characteristics of the examples are not substantially affected.

Hereunder, the invention is elucidated in detail in reference to several examples of the present invention.

EXAMPLE 1

$Bi_2O_3$ powder, CoO powder, $MnO_2$ powder, $TiO_2$ powder and NiO powder are added to ZnO powder at the rates of 0.01 to 10 mol%, respectively, the above are well mixed and mould into a wafer of 17.5 mm diameter and 1.2 mm thickness. The mould is baked in air at a temperature of 1000° - 1500° C to form a varistor bulk.

Then, a glass frit is prepared by mixing 80 to 95% by weight of $Bi_2O_3$ and 5 to 20% by weight of $SiO_2$ together, by adding 0 to 20 parts by weight of $B_2O_3$ respectively for 100 parts by weight of the above mixture, further mixing and melting the above in an alumina pot at 800° to 1300° C for 30 minutes. Then, the resultant glass is thrown into water for quick cooling and grinding, and the ground glass granule is further pulverized to form the frit.

Then a silver paste is formed by mixing 50 parts by weight of silver powder (of 0.1 to 10 micron powder diameter), 10 parts by weight of the glass frit, 5 parts by weight of ethylcellulose, 5 parts by weight of n-butyl acetate, 30 parts by weight of butylcarbitol together and sufficiently knead the mixture to obtain a homogeneous pasty composition.

The abovementioned silver paste is applied on both principal faces of the aforementioned varistor bulk by the amount of 20 to 60 mg per each bulk, and the bulk is baked in air at 600 to 900° C for 0.5 to 2 hours.

Figure 2:
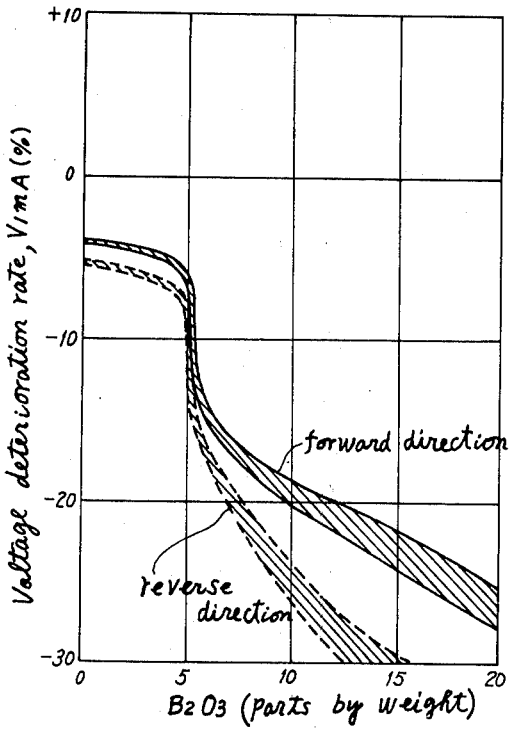
Figure 3:
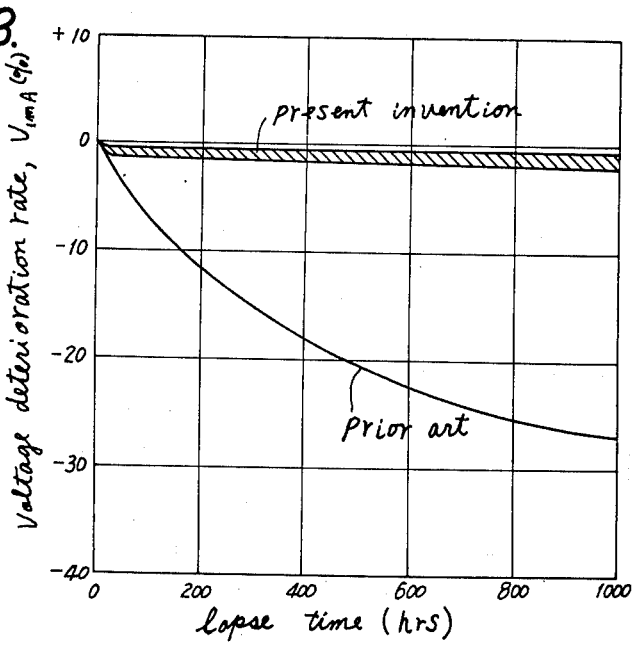

Characteristics of the varistor made by the abovementioned steps are shown by graphs of FIGS. 1 to 3, wherein hatched region defined between two curves indicates the region within which the characteristic curves vary responding to changes of the contents of the bulk and the silver paste, amount of the paste applied and conditions of baking within the aforementioned ranges. Namely, even though the conditions vary within the aforementioned ranges, the characteristic curves converge within a considerably narrow hatched ranges.

FIG. 1 shows the relation between the amount of $B_2O_3$ and the value of exponent $\alpha$. For the amount of $B_2O_3$ of over 1 weight part, the exponent $\alpha$ prominently increases showing superior voltage stabilization characteristic.

FIG. 2 shows the relation between the amount of $B_2O_3$ in the glass frit and the rate of deterioration of the voltage across the electrodes after a test by large current impulses. The test is conducted by applying two impulse currents of 500A (by peak value) of the wave form of the aforementioned $8 \times 20\ \mu s$ in the same direction. As is clear from FIG. 2, for the amount of $B_2O_3$ of over 5 weight parts, both the deterioration rate of the voltage $V_{1mA}$ for 1mA current and difference between the deterioration rates of forward and reverse directions increase.

FIG. 3 shows relation between the lapse time from a start of applying A.C. voltage and the deterioration rate of the varistor voltage of the present example and an example of the prior art. The prior art example is made with the same varistor bulk to the present example, and its electrodes are made by employing the silver paste prepared by the same steps employing the materials of 14 parts by weight of $Ag_2O$ and 30 parts by weight of $B_2O_3$ to 100 parts by weight of the mixture of 85% by weight of $Bi_2O_3$ and 15% by weight of $SiO_2$. The characteristics of the deterioration ratio are tested at 70° C by applying A.C. voltage having peak value Vp of $V_{1mA}$, which is the varistor voltage for 1mA current of the varistor. As can be understood from FIG. 3, it is observed that the varistor of the present invention has been drastically improved also for A.C. loading operation. Namely, characteristic of the A.C. operation of the varistor, as well as that of the D.C. operation, is drastically improved, and accordingly, expansion of applications of the varistor can be expected.

Concerning the effect of the amount of $Bi_2O_3$, for less than 80% by weight the deterioration by the impulsive current becomes too large, and for more than 95% by weight the value of the exponent $\alpha$ becomes poor.

Concerning the effect of the amount of $SiO_2$, for less than 5% the value of the exponent $\alpha$ becomes poor, and for more than 20% the voltage resistance of the varistor becomes too high.

Summarizing the example 1, it becomes clear that the silver paste prepared by mixing and kneading silver powder, synthetic resin, solvent and glass frit, which is prepared by mixing 80 to 95% buy weight of $Bi_2O_3$ and 5 to 20% by weight of $SiO_2$, adding 1 to 5 parts by weight of $B_2O_3$, respectively to 100 parts by weight of said mixture, further mixing the above, firing and pulverizing, has great advantage when used in making electrode on zinc oxide type varistor by applying and baking it.

EXAMPLE 2

$Bi_2O_3$ powder, CoO power, $MnO_2$ powder, $TiO_2$ powder and NiO powder are added to ZnO powder at the rate of 0.01 to 10 mol %, respectively, the above are well mixed and mould into a wafer of 17.5 mm diameter and 1.2 mm thickness. The mould is baked in air at a temperature of 1000° - 1500° C to form a varistor bulk.

Then a glass frit is prepared by mixing 80 - 95% by weight of $Bi_2O_3$, 5 to 20% by weight of $SiO_2$ together, by adding 0 to 20 parts by weight of $B_2O_3$ and 0 to 40 parts by weight of CoO, respectively for 100 parts by weight of the above mixture, further mixing and melting the above in an alumina pot at 800 to 1300° C for 30 minutes. Then, the resultant glass is thrown into water for quick cooling and grinding, and the ground glass granule is further pulverized to form the frit.

Then a silver paste is formed by mixing 50 parts by weight of silver (of 0.1 to 10 micron powder diameter), 10 parts by weight of the glass frit, 5 parts by weight of ethylcellulose, 5 parts by weight of n-butyl acetate, 30 parts by weight of butylcarbitol together and sufficiently knead the mixture to obtain a homogeneous pasty composition.

The abovementioned silver paste is applied on both principal faces of the aforementioned varistor bulk by the amount of 20 to 60 mg per each bulk, and the bulk is baked in air at 600° to 900° C for 0.5 to 2 hours.

Characteristics of the varistor made by the abovementioned steps are shown by graphs of FIGS. 4 to 7, wherein hatched region defined between two curves indicates the region within which the characteristic curves vary responding to the changes of the contents of the bulk and the silver paste, amount of the paste applied and conditions of baking within the aforementioned ranges. Namely, even though the conditions vary within the aforementioned ranges, the characteristic curves converge within a considerably narrow hatched ranges.

Figure 4:
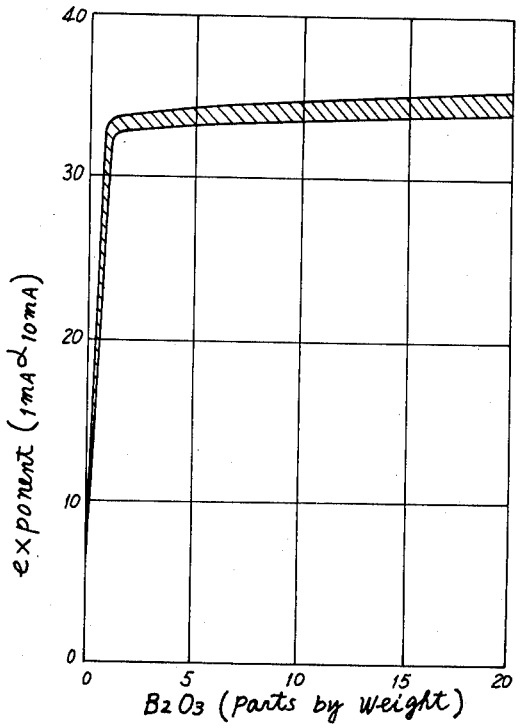

FIG. 4 shows relation between the amount of $B_2O_3$ and the value of exponent $\alpha$. For the amount of $B_2O_3$ of over 1 weight part, the exponent $\alpha$ prominently increases showing superior voltage stabilization characteristic.

Figure 5:
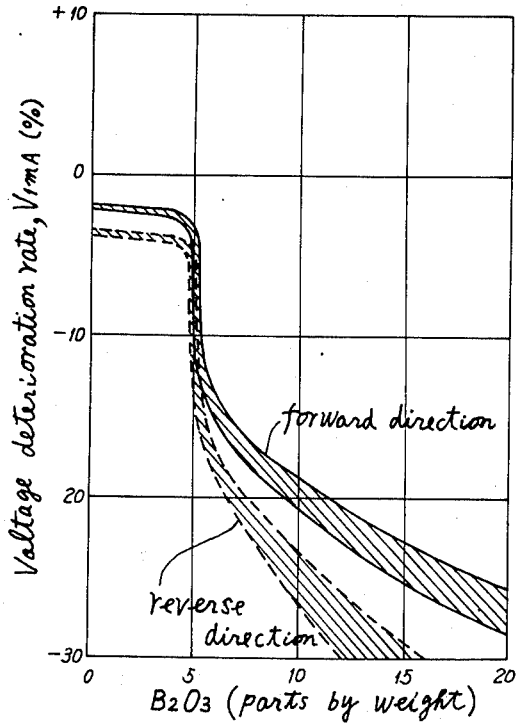

FIG. 5 shows the relation between the amount of $B_2O_3$ in the glass frit and the rate of deterioration of the voltage across the electrodes after a test by large current impulses. The test is conducted by applying two impulse currents of 500A (by peak value) of the waveform of the aforementioned $8 \times 20$ μs in the same direction. As is clear from FIG. 5, for the amount of $B_2O_3$ of over 5 weight parts, both the deterioration rate of the voltage $V_{1mA}$ for 1mA current and difference between the deterioration rates of forward and reverse directions increase.

Figure 6:
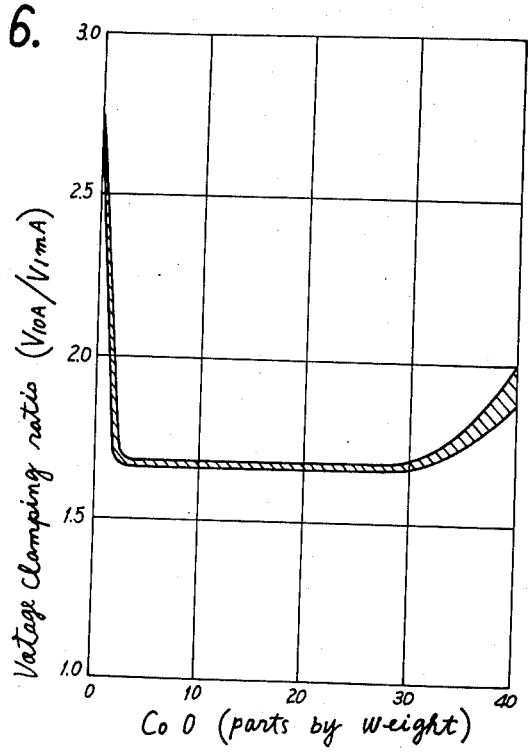

FIG. 6 shows relation between the amounts of CoO in the glass frit and the voltage clamping ratio. The graph shows that for the amount of more than 2 weight part of CoO, the clamping ratio $V_{10A}/V_{1mA}$ becomes small and satisfactory surge absorbing characteristic is obtainable. However, when the CoO amount exceeds 30 weight parts, then the clamping ratio becomes large. Namely, for 2 to 30 parts by weight of CoO the improvement of the clamping ratio is obtainable.

Figure 7:
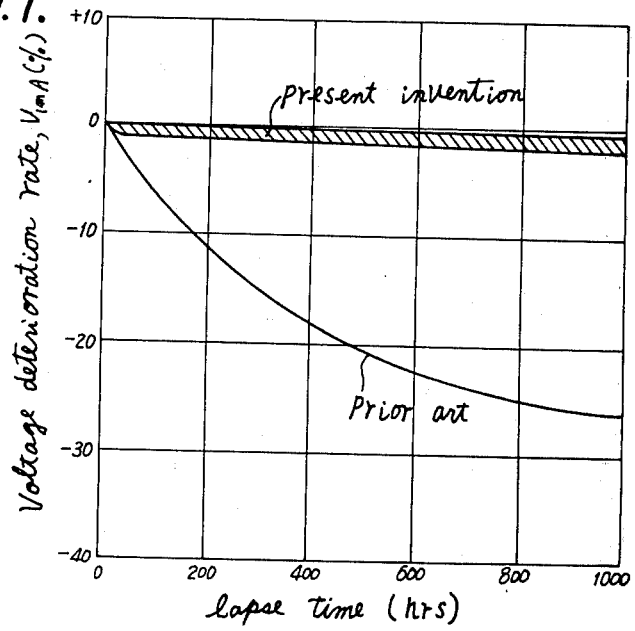

FIG. 7 shows relations between the lapse time from a start of applying A.C. voltage and the deterioration rate of the varistor voltage, of the present example and an example of the prior art. The prior art example is made with the same varistor bulk to the present example, and its electrodes are made by employing the silver paste prepared by the same steps employing the materials of 14 parts by weight of $Ag_2O$ and 30 parts by weight of $B_2O_3$ to 100 parts by weight of the mixture of 85% by weight of $Bi_2O_3$ and 15% by weight of $SiO_2$. The characteristics of the deterioration rates are tested at 70° C by applying A.C. voltage having peak value Vp of $V_{1mA}$, which is the varistor voltage for 1mA current of the varistor. As can be understood from FIG. 7 it is observed that the varistor of the present invention has been drastically improved also for A.C. loading operation. Namely, characteristic of the A.C. operation of the varistor as well as that of the D.C. operation, is drastically improved, and accordingly, expansion of applications of the varistor can be expected.

Concerning the effect of the amount of $Bi_2O_3$, for less than 80% by weight the deterioration by the impulsive current becomes too large, and for more than 95% by weight the value of the exponent $\alpha$ becomes poor.

Concerning the effect of the $SiO_2$, for less than 5% the value of the exponent $\alpha$ becomes poor, and for more than 20% the voltage resistance of the varistor becomes too high.

Summarizing the example 2, it becomes clear that the silver paste prepared by mixing and kneading silver powder, synthetic resin, solvent and glass frit, which is prepared by mixing 80 to 95% by weight of $Bi_2O_3$ and 5 to 20% by weight of $SiO_2$ adding 1 to 5 parts by weight of $B_2O_3$ and 2 to 30 parts by weight of CoO, respectively to 100 parts by weight of said mixture, further mixing the above, firing and pulverizing, has great advantage when used in making electrode on zinc oxide type vairstor by applying and baking it.

EXAMPLE 3

$Bi_2O_3$ powder, CoO powder, $MnO_2$ powder, $TiO_2$ powder and NiO powder are added to ZnO powder at the rate of 0.01 to 10 mol %, respectively, the above are well mixed and mould into a wafer of 17.5 mm diameter and 1.2 mm thickness. The mould is baked is air at a temperature of 1000° - 1500° C to form a varistor bulk.

Then a glass frit is prepared by mixing 80 - 95% by weight of $Bi_2O_3$, 5 to 20% by weight of $SiO_2$ together, by adding 0 to 20 parts by weight of $B_2O_3$ and 0 to 40 parts by weight of $Sb_2O_3$, respectively, for 100 parts by weight of the above mixture, further mixing and melting the above in an alumina pot at 800° to 1300° C for 30 minutes. Then, the resultant glass is thrown into water for quick cooling and grinding, and the ground glass granule is further pulverized to form the frit.

Then a silver paste is formed by mixing 50 parts by weight of silver (of 0.1 to 10 micron powder diameter), 10 parts by weight of the glass frit, 5 parts by weight of ethylcellulose, 5 parts by weight of n-butyl acetate, 30 parts by weight of butylcarbitol together and sufficiently knead the mixture to obtain a homogeneous pasty composition.

The abovementioned silver paste is applied on both principal faces of the aforementioned varistor bulk by the amount of 20 to 60 mg per each bulk, and the bulk is baked in air at 600° to 900° C for 0.5 to 2 hours.

Characteristics of the varistor made by the abovementioned steps are shown by graphs of FIGS. 8 to 11, wherein hatched region defined between two curves indicates the region within which the characteristic curves vary responding to the changes of the contents of the bulk and the silver paste, amount of the paste applied and conditions of baking within the aforementioned ranges. Namely, even though the conditions vary within the aforementioned ranges, the characteristic curves converge within a considerably narrow hatched ranges.

Figure 8:
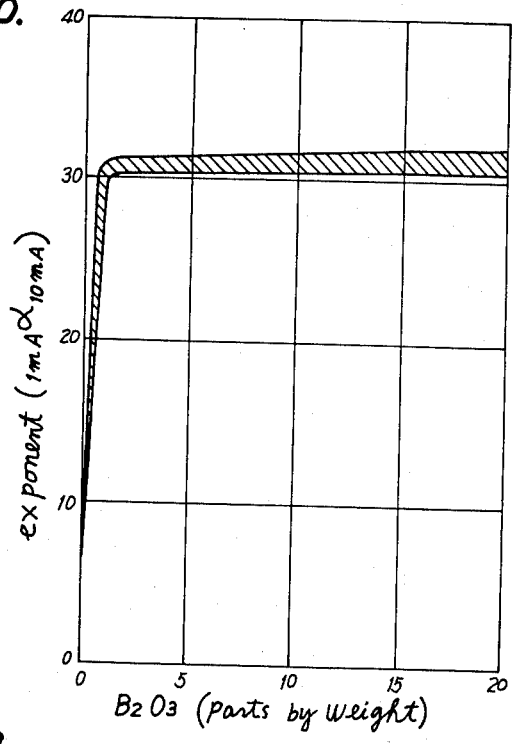

FIG. 8 shows relation between the amount of $B_2O_3$ and the value of exponent $\alpha$. For the amount of $B_2O_3$ of over 1 weight part, the exponent $\alpha$ prominently increases showing superior voltage stabilization characteristic.

Figure 9:
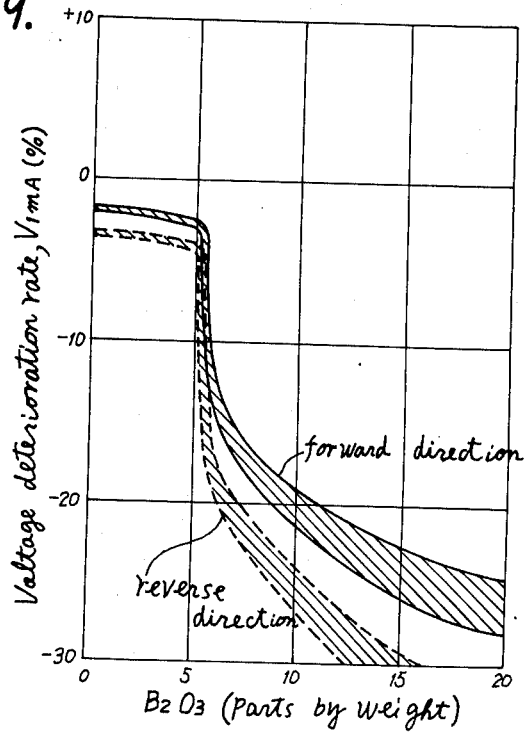

FIG. 9 shows the relation between the amount of $B_2O_3$ in the glass frit and the rate of deterioration of the voltage across the electrodes after a test by large current impulses. The test is conducted by applying two impluse currents of 500A (by peak value) of the waveform of the aforementioned $8 \times 20$μs in the same direction. As is clear from FIG. 9, for the amount of $B_2O_3$ of over 5 weight parts, both the deterioration rate of the voltage $V_{1mA}$ for 1mA current and difference between the deterioration rates of forward and reverse directions increase.

Figure 10:
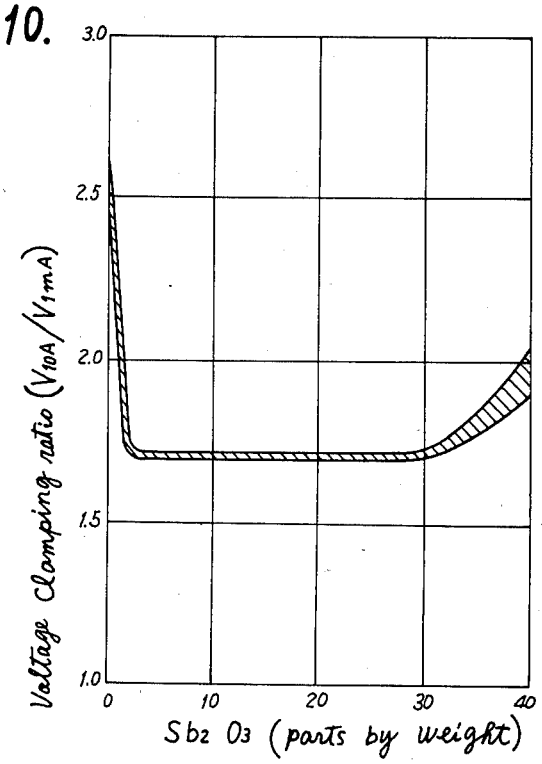

FIG. 10 shows relation between the amounts of $Sb_2O_3$ in the glass frit and the voltage clamping ratio. The graph shows that for the amount of more than 2 weight part of $Sb_2O_3$, the clamping ratio $V_{10A}/V_{1mA}$ becomes small and satisfactory current stabilization characteristic is obtainable. However, when the $Sb_2O_3$ amount exceeds 30 weight parts, then the clamping ratio becomes large. Namely, for 2 to 30 parts by weight of $Sb_2O_3$ the improvement of the clamping ratio is obtainable.

Figure 11:
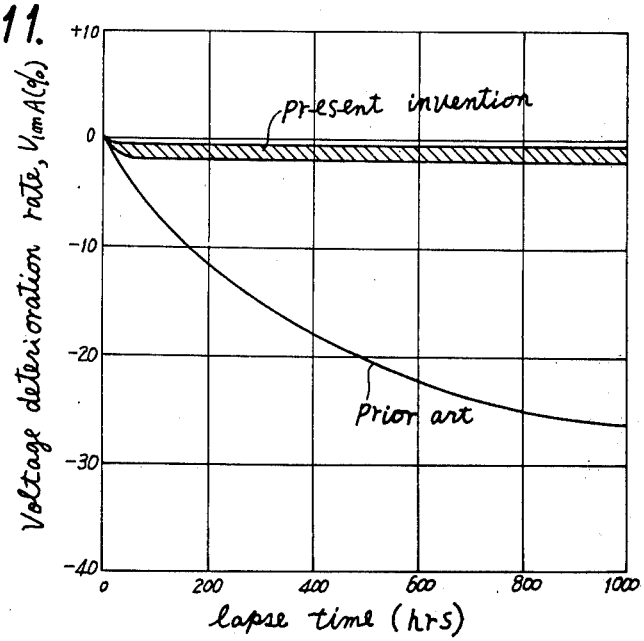

FIG. 11 shows relations between the lapse time from a start of applying A.C. voltage and the deterioration rate of the varistor voltage, of the present example and an example of the prior art. The prior art example is made with the same varistor bulk to the present example, and its electrodes are made by employing the silver paste prepared by the same steps employing the materials of 14 parts by weight of $Ag_2O$ and 30 parts by weight of $B_2O_3$ to to 100 parts by weight of the mixture of 85% by weight of $Bi_2O_3$ and 15% by weight of $SiO_2$. The characteristics of the deterioration rates are tested at 70° C by applying A.C. voltage having peak value Vp of $V_{1mA}$, which is the varistor voltage for 1mA current of the varistor. As can be understood from FIG. 11, it is observed that the varistor of the present invention has been drastically improved also for A.C. loading operation. Namely, characteristic of the A.C. operation of the varistor, as well as that of the D.C. operation, is drastically improved, and accordingly, expansion of applications of the varistor can be expected.

Concerning the effect of the amount of $Bi_2O_3$, for less than 80% by weight the deterioration by the impulsive current becomes too large, and for more than 95% by weight the value of the exponent $\alpha$ becomes poor.

Concerning the effect of the $SiO_2$, for less than 5% the value of the exponent $\alpha$ becomes poor, and for more than 20% the voltage resistance of the varistor becomes too high.

Summarizing the example 3, it becomes clear that the silver paste prepared by mixing and kneading silver powder, synthetic resin, solvent and glass frit, which is prepared by mixing 80 to 95% by weight of $Bi_2O_3$ and 5 to 20% by weight of $SiO_2$ adding 1 to 5 parts by weight of $B_2O_3$ and 2 to 30 parts by weight of $Sb_2O_3$, respectively to 100 parts by weight of said mixture, further mixing the above, firing and pulverizing, has great advantage when used in making electrode on zinc oxide type varistor by applying and baking it.

EXAMPLE 4

$Bi_2O_3$ powder, CoO powder, $MnO_2$ powder, $TiO_2$ powder and NiO powder are added to ZnO powder at the rate of 0.01 to 10 mol %, respectively, the above are well mixed and mould into a wafer of 17.5 mm diameter and 1.2 mm thickness. The mould is baked in air at a temperature of 1000° - 1500° C to form a varistor bulk.

Then a glass frit is prepared by mixing 80 - 95% by weight of $Bi_2O_3$, 5 to 20% by weight of $SiO_2$ together, by adding 0 to 20 parts by weight of $B_2O_3$, 0 to 40 parts by weight of $Sb_2O_3$ and 0 - 40 parts by weight of $Ag_2O$, respectively, for 100 parts by weight of the above mixture, further mixing and melting the above in an alumina pot at 800° to 1300° C for 30 minutes. Then, the resultant glass is thrown into water for quick cooling and grinding, and the ground glass granule is further pulverized to form the frit.

Then a silver paste is formed by mixing 50 parts by weight of silver (of 0.1 to 10 micron powder diameter), 10 parts by weight of glass frit, 5 parts by weight of ethylcellulose, 5 parts by weight of n-butyl acetate, 30 parts by weight of butylcarbitol together and sufficiently knead the mixture to obtain a homogeneous pasty composition.

The abovementioned silver paste is applied on both principal faces of the aforementioned varistor bulk by the amount of 20 to 60 mg per each bulk, and the bulk is baked in air at 600° to 900° C for 0.5 to 2 hours.

Characteristics of the varistor made by the abovementioned steps are shown by graphs of FIGS. 12 to 16, wherein hatched region defined between two curves indicates the region within which the characteristic curves vary responding to the changes of the contents of the bulk and the silver paste, amount of the paste applied and conditions of baking within the aforementioned ranges. Namely, even though the condition vary within the aforementioned ranges, the characteristics curves converge within a considerably narrow hatched ranges.

Figure 12:
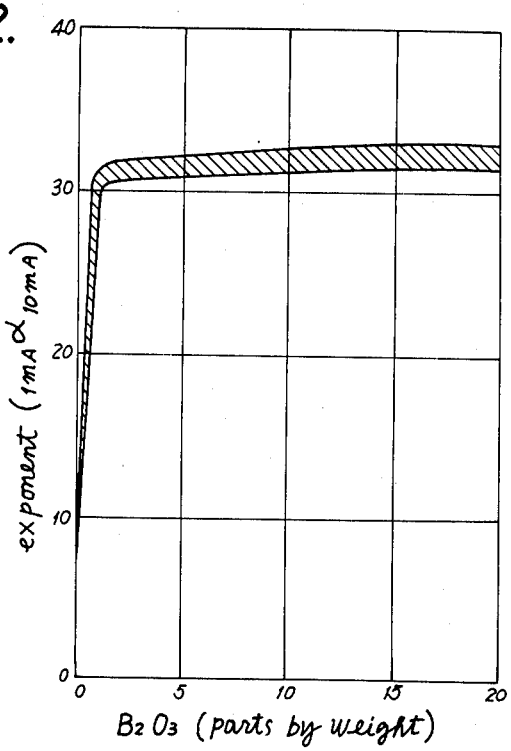

FIG. 12 shows relation between the amount of $B_2O_3$ and the value of exponent $\alpha$. For the amount of $B_2O_3$ of over 1 weight part, the exponent $\alpha$ prominently increases showing superior voltage stabilization characteristic.

Figure 13:
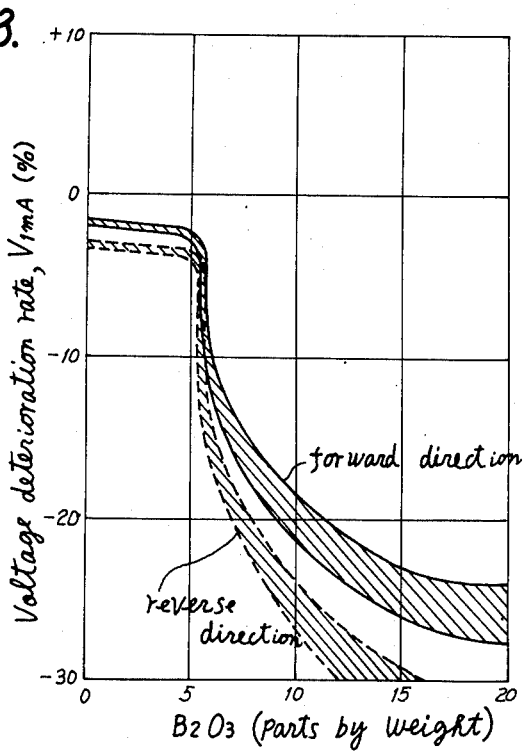

FIG. 13 shows the relation between the amount of $B_2O_3$ in the glass frit and the rate of deterioration of the voltage across the electrodes after a test by large current impulses. The test is conducted by applying two impulse currents of 500A (by peak value) of the waveform of the aforementioned $8 \times 20$ μs in the same direction. As is clear from FIG. 13, for the amount of $B_2O_3$ of over 5 weight parts, both the deterioration rate of the voltage $V_{1mA}$ for 1mA current and difference between the deterioration rates of forward and reverse directions increase.

Figure 14:
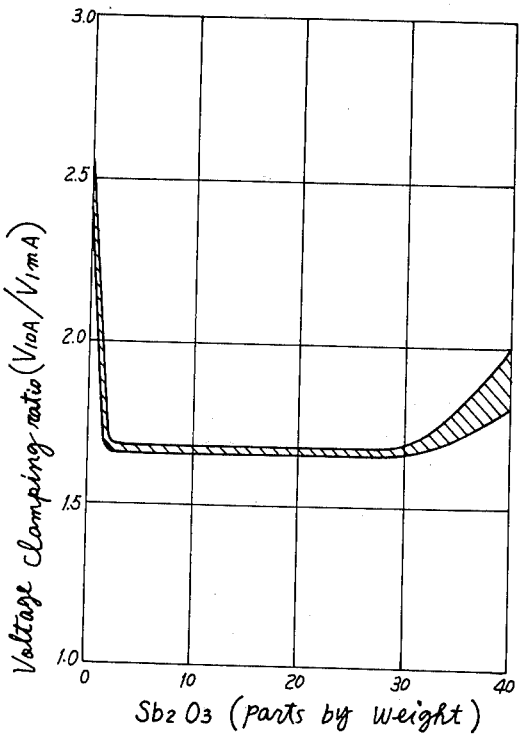

FIG. 14 shows relation between the amounts of $Sb_2O_3$ in the glass frit and the voltage clamping ratio. The graph shows that for the amount of more than 2 weight part of $Sb_2O_3$, the clamping ratio $V_{10A}/V_{1mA}$ becomes small and satisfactory current stabilization characteristic is obtainable. However, when the $Sb_2O_3$ amount exceeds 30 weight parts, then the clamping ratio becomes large. Namely, for 2 to 30 parts by weight of $SB_2O_3$ the improvement of the clamping ratio is obtainable.

Figure 15:
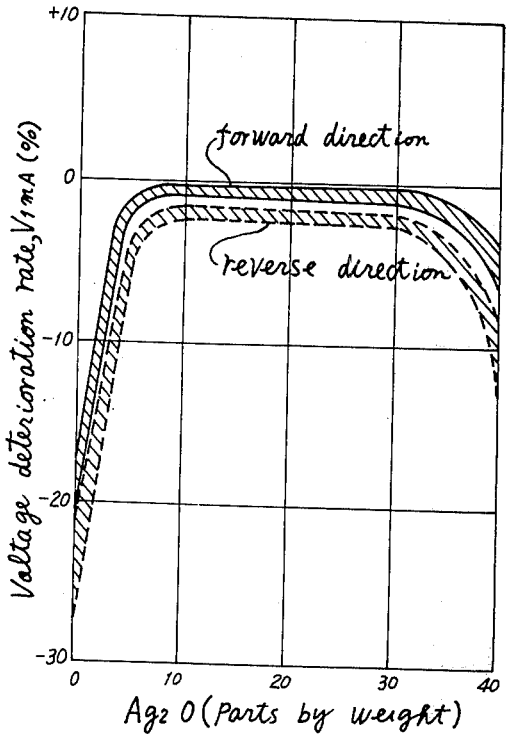

FIG. 15 shows the relation between the amount of $Ag_2O$ in the glass frit and the rate of deterioration of the voltage across the electrodes after a surge test by many current impulses. The test is conducted by applying 10,000 impulse currents of 50A (by peak value) of the waveform of the aforementioned $8 \times 20$ μs with 2 second intervals inbetween the pulses in the same direction. As is clear from FIG. 15, for the amount of $Ag_2O$ of over 5 weight parts, the absolute deterioration rates of the voltage $V_{1mA}$ for 1mA current prominently decrease and over 35 weight parts the absolute value of the deterioration rates again increase. Besides, for the amount of over 35 weight parts, silver lumps are produced in the frit and therefore making of homogeneous glass frit becomes difficult. As is abovementioned, the amount of 5 to 35 weight parts of $Ag_2O$ is effective in surge life test.

Figure 16:
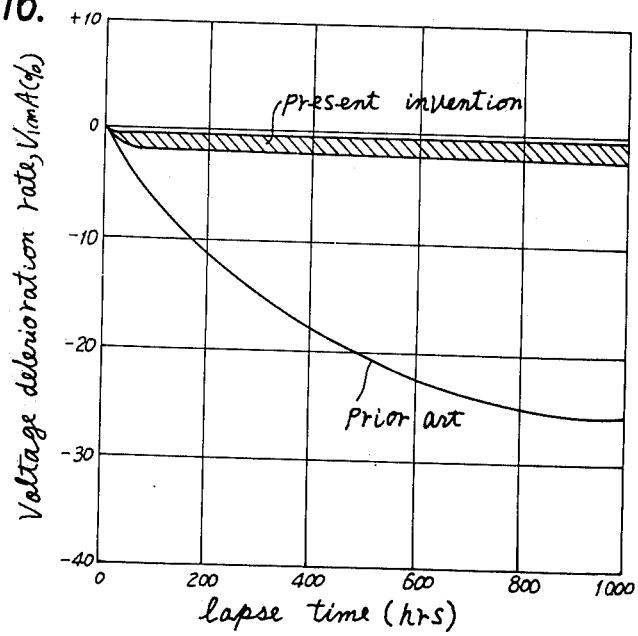

FIG. 16 shows relations between the lapse time from a start of applying A.C. voltage and the deterioration rate of the varistor voltage, of the present example and an example of the prior art. The prior art example is made with the same varistor bulk to the present example, and its electrodes are made by employing the silver paste prepared by the same steps employing the materials of 14 parts by weight of $Ag_2O$ and 30 parts by weight of $B_2O_3$ to 100 parts by weight of the mixture of 85% by weight of $Bi_2O_3$ and 15% by weight of $SiO_2$. The characteristics of the deterioration rates are tested at 70° C by applying A.C. voltage having peak value Vp of $V_{1mA}$, which is the varistor voltage for 1mA current of the varistor. As can be understood from FIG. 16 it is observed that the varistor of the present invention has been drastically improved also for A.C. loading operation. Namely, characteristic of the A.C. operation of the varistor, as well as that of the D.C. operation, is drastically improved, and accordingly, expansion of applications of the varistor can be expected.

Concerning the effect of the amount of $Bi_2O_3$, for less than 80% by weight the deterioration by the impulsive current becomes too large, and for more than 95% by weight the value of the exponent $\alpha$ becomes poor.

Concerning the effect of the $SiO_2$, for less than 5% the value of the exponent becomes poor, and for more than 20% the voltage resistance of the varistor becomes too high.

Summarizing the example 4, it becomes clear that the silver paste prepared by mixing and kneading silver powder, synthetic resin, solvent and glass frit, which is prepared by mixing 80 to 95% by weight of $Bi_2O_3$ and 5 to 20% by weight of $SiO_2$ adding 1 to 5 parts by weight of $B_2O_3$, 2 to 30 parts by weight of $Sb_2O_3$ and 5 to 35 parts by weight of $Ag_2O$, to 100 parts by weight of said mixture, further mixing the above, firing and pulverizing, has great advantage when used in making electrode on zinc oxide type varistor by applying and baking it.

EXAMPLE 5

$Bi_2O_3$ powder, CoO powder, $MnO_2$ powder, $TiO_2$ powder and NiO powder are added to ZnO powder at the rate of 0.01 to 10 mol %, respectively, the above are well mixed and mould into a wafer of 17.5 mm diameter and 1.2 mm thickness. The mould is baked in air at a temperature of 1000° - 1500° C to form a varistor bulk.

Then a glass frit is prepared by mixing 80 - 95% by weight of $Bi_2O_3$, 5 to 20% by weight of $SiO_2$ together, by adding 0 to 20 parts by weight of $B_2O_3$ and 0 to 40 parts by weight of $Sb_2O_3$ and 0 to 40 parts by weight of MgO, respectively for 100 parts by weight of the above mixture, further mixing and melting the above in an alumina pot at 800° to 1300° C for 30 minutes. Then, the resultant glass is thrown into water for quick cooling and grinding, and the ground glass granule is further pulverized to form the frit.

Then a silver paste is formed by mixing 50 parts by weight of silver (of 0.1 to 10 micron powder diameter), 10 parts by weight of the glass frit, 5 parts by weight of ethylcellulose, 5 parts by weight of n-butyl acetate, 30 parts by weight of butylcarbitol together and sufficiently knead the mixture to obtain a homogeneous pasty composition.

The abovementioned silver paste is applied on both principal faces of the aforementioned varistor bulk by the amount of 20 to 60 mg per each bulk, and the bulk is baked in air at 600° to 900° C for 0.5 to 2 hours.

Characteristics of the varistor made by the abovementioned steps are shown by graphs of FIGS. 17 to 21, wherein hatched region defined between two curves indicates the region within which the characteristic curves vary responding to the changes of the contents of the bulk and the silver paste, amount of the paste applied and conditions of baking within the aforementioned ranges. Namely, even though the conditions vary within the aforementioned ranges, the characteristic curves converge within a considerably narrow hatched ranges.

Figure 17:
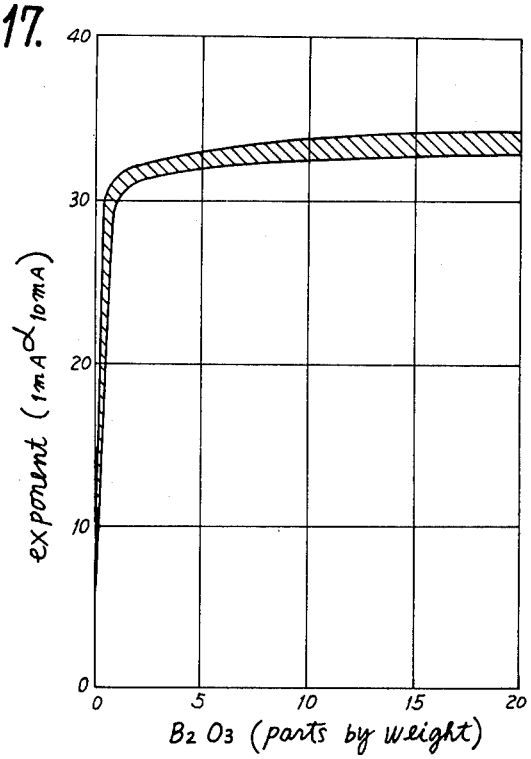

FIG. 17 shows relation between the amount of $B_2O_3$ and the value of exponent $\alpha$. For the amount of $B_2O_3$ of over 1 weight part, the exponent $\alpha$ prominently increases showing superior voltage stabilization characteristic.

Figure 18:
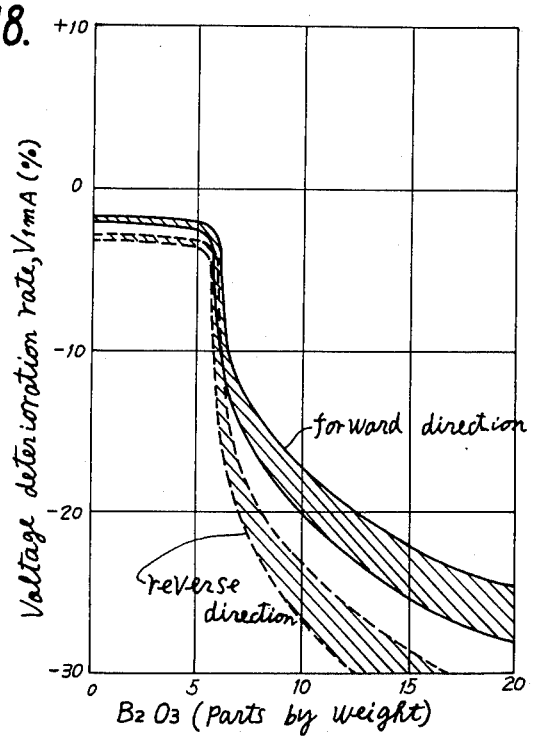

FIG. 18 shows the relation between the amount of $B_2O_3$ in the glass frit and the rate of deterioration of the voltage across the electrodes after a test by large current impulses. The test is conducted by applying two impulse currents of 500A (by peak value) of the waveform of the aforementioned $8 \times 20$ $\mu$s in the same direction. As is clear from FIG. 18, for the amount of $B_2O_3$ of over 5 weight parts, both the deterioration rate of the voltage $V_{1mA}$ for 1mA current and difference between the deterioration rates of forward and reverse directions increase.

Figure 19:
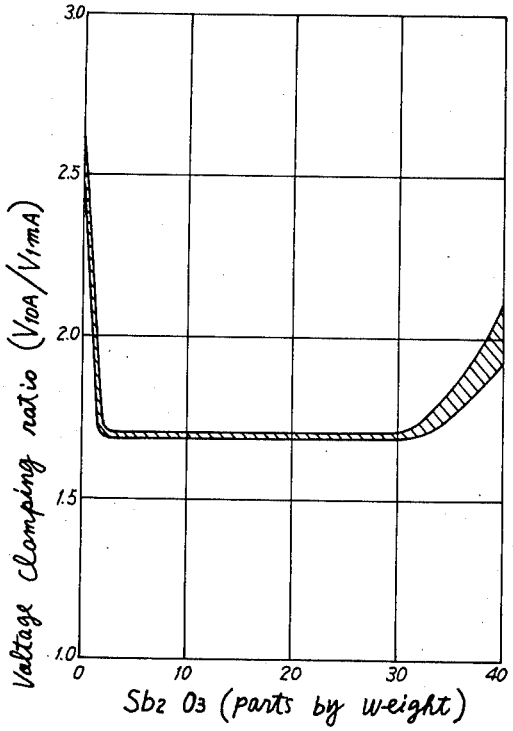

FIG. 19 shows relation between the amounts of $Sb_2O_3$ in the glass frit and the voltage clamping ratio. The graph shows that for the amount of more than 2 weight part of $Sb_2O_3$ the clamping ratio $V_{10A}/V_{1mA}$ becomes small and satisfactory current stabilization characteristic is obtainable. However, when the $Sb_2O_3$ amount exceeds 30 weight parts, then the clamping ratio becomes large. Namely, for 2 to 30 parts by weight of $SB_2O_3$ the improvement of the clamping ratio is obtainable.

Figure 20:
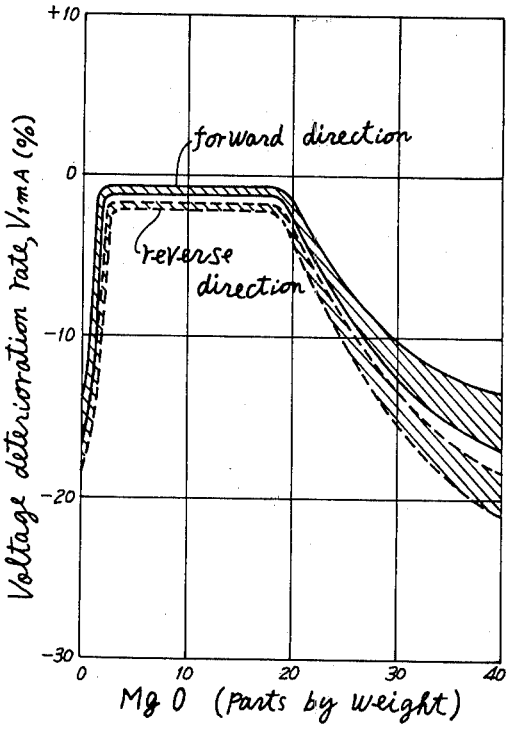

FIG. 20 shows the relation between the amount of MgO in the glass frit and the ratio of deterioration of the voltage across the electrodes after a surge test by many current impulses. The test is conducted by applying 10,000 inpulse currents of 50 A (by peak value) of the waveform of the aforementioned $8 \times 20$ $\mu$s with 2 second intervals inbetween the pulses in the same direction. As is clear from FIG. 20, for the amount of MgO of over 2 weight parts, the absolute deterioration rates of the voltage $V_{1mA}$ for 1mA current prominently decrease and over 20 weight parts the absolute value of the deterioration rates again increase. As is abovementioned, the amount of 2 to 20 weight parts of MgO is effective in surge life test.

Figure 21:
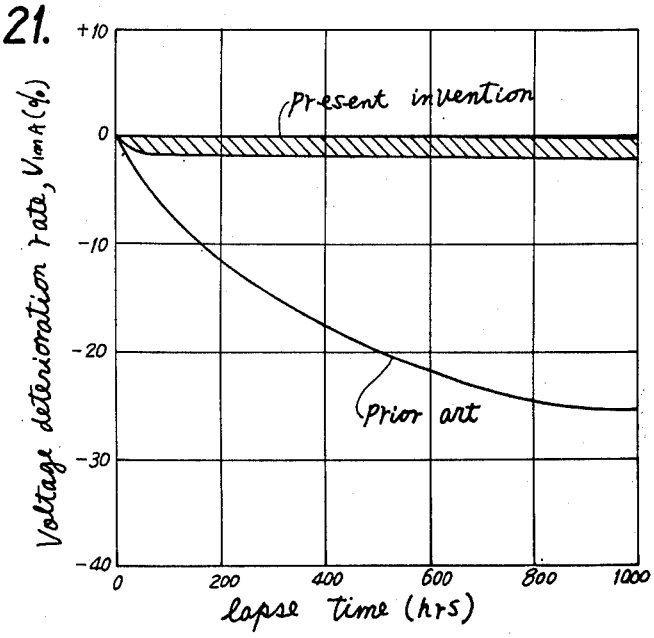

FIG. 21 shows relations between the lapse time from a start of applying A.C. voltage and the deterioration rate of the varistor voltage, of the present example and an example of the prior art. The prior art example is made with the same varistor bulk to the present example, and its electrodes are made by employing the silver paste prepared by the same steps employing the materials of 14 parts by weight of $Ag_2O$ and 30 parts by weight of $B_2O_3$ to to 100 parts by weight of the mixture of 85% by weight of $Bi_2O_3$ and 15% by weight of $SiO_2$. The characteristics of the deterioration rates are tested at 70° C by applying A.C. voltage having peak value Vp of $V_{1mA}$, which is the varistor voltage for 1mA current of the varistor. As can be understood from FIG. 7, it is observed that the varistor of the present invention has been drastically improved also for A.C. loading operation. Namely, characteristic of the A.C. operation of the varistor, as well as that of the D.C. operation, is drastically improved, and accordingly, expansion of applications of the varistor can be expected.

Concerning the effect of the amount of $Bi_2O_3$, for less than 80% by weight the deterioration by the impulsive current becomes too large, and for more than 95% by weight the value of the exponent $\alpha$ becomes poor.

Concerning the effect of the $SiO_2$, for less than 5% the value of the exponent $\alpha$ becomes poor, and for more than 20% the voltage resistance of the varistor becomes too high.

Summarizing the example 5, it becomes clear that the silver paste prepared by mixing and kneading silver powder, synthetic resin, solvent and glass frit, which is prepared by mixing 80 to 95% by weight of $Bi_2O_3$ and 5 to 20% by weight of $SiO_2$ adding 1 to 5 parts by weight of $B_2O_3$ and 2 to 30 parts by weight of $Sb_2O_3$ and 2 to 20 parts by weight of MgO, respectively to 100 parts by weight of said mixture, further mixing the above, firing and pulverizing, has great advantage when used in making electrode on zinc oxide type varistor by applying and baking it.

EXAMPLE 6

$Bi_2O_3$ powder, CoO powder, $MnO_2$ powder, $TiO_2$ powder and NiO powder are added to ZnO powder at the rate of 0.01 to 10 mol %, respectively, the above are well mixed and mould into a wafer of 17.5 mm diameter and 1.2 mm thickness. The mould is baked in air at a temperature of 1000° - 1500° C to form a varistor bulk.

Then a glass frit is prepared by mixing 80 - 95% by weight of $Bi_2O_3$, 5 to 20% by weight of $SiO_2$ together, by adding 0 to 20 parts by weight of $B_2O_3$ and 0 to 40 parts by weight of CoO and 0 to 40 parts by weight of MgO, respectively for 100 parts by weight of the above mixture, further mixing and melting the above in an alumina pot at 800° to 1300° C for 30 minutes. Then, the resultant glass is thrown into water for quick cooling and grinding, and the ground glass granule is further pulverized to form the frit.

Then a silver paste is formed by mixing 50 parts by weight of silver (of 0.1 to 10 micron powder diameter), 10 parts by weight of the glass frit, 5 parts by weight of ethylcellulose, 5 parts by weight of n-butyl acetate, 30 parts by weight of butylcarbitol together and sufficiently knead the mixture to obtain a homogeneous pasty composition.

The abovementioned silver paste is applied on both principal faces of the aforementioned varistor bulk by the amount of 20 to 60 mg per each bulk, and the bulk is baked in air at 600° to 900° C for 0.5 to 2 hours.

Characteristics of the varistor made by the abovementioned steps are shown by graphs of FIGS. 22 to 26, wherein hatched region defined between two curves indicates the region within which the characteristic curves vary responding to the changes of the contents of the bulk and the silver paste, amount of the past applied and conditions of baking within the aforementioned ranges. Namely, even though the conditions vary within the aforementioned ranges, the characteristic curves converge within a considerably narrow hatched ranges.

Figure 22:
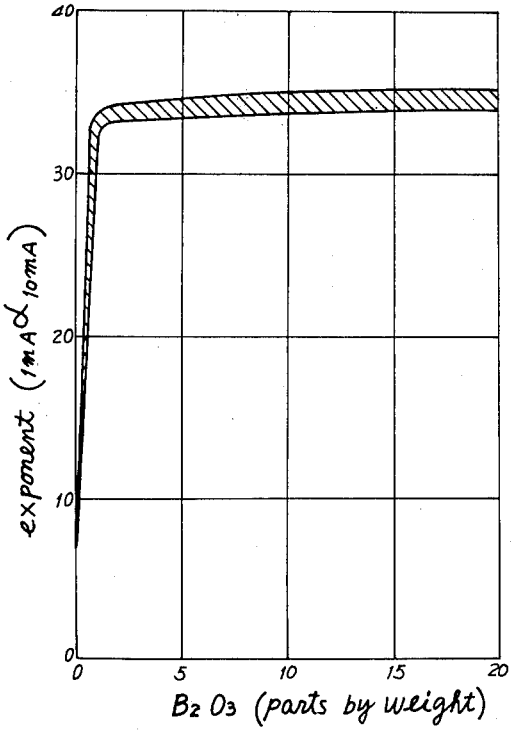

FIG. 22 shows relation between the amount of $B_2O_3$ and the value of exponent $\alpha$. For the amount of $B_2O_3$ of over 1 weight part, the exponent $\alpha$ prominently increases showing superior voltage stabilization characteristic.

Figure 23:
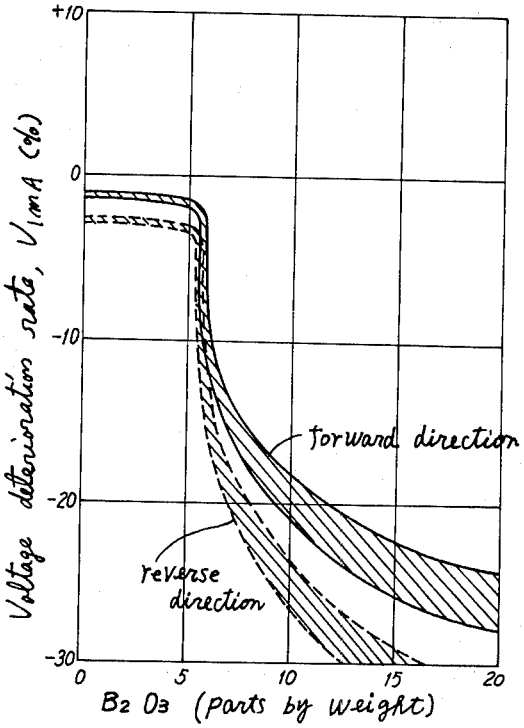

FIG. 23 shows the relation between the amount of $B_2O_3$ in the glass frit and the rate of deterioration of the voltage across the electrodes after a test by large current impulses. The test is conducted by applying two impulse currents of 500 A (by peak value) of the waveform of the aforementioned $8 \times 20$ μs in the same direction. As is clear from FIG. 23, for the amount of $B_2O_3$ of over 5 weight parts, both the deterioration rate of the voltage $V_{1mA}$ for 1mA current and difference between the deterioration rates of forward and reverse directions increase.

Figure 24:
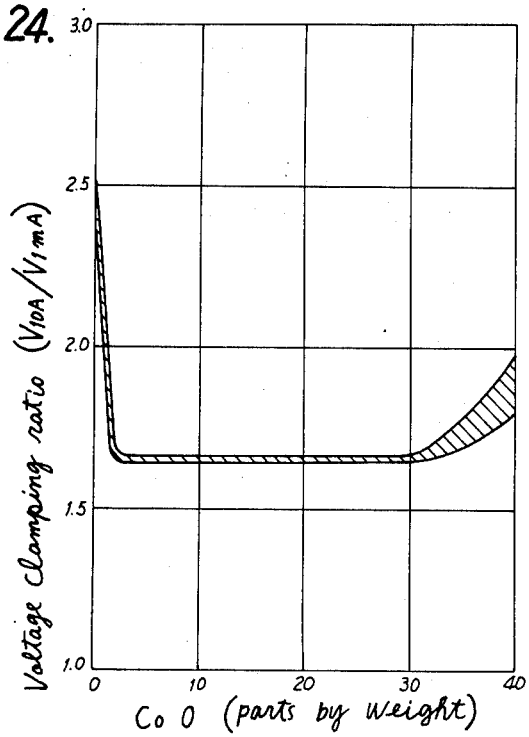

FIG. 24 shows relation between the amounts of CoO in the glass frit and the voltage clamping ratio. The graph shows that for the amount of more than 2 weight part of CoO, the clamping ratio $V_{10A}/V_{1mA}$ becomes small and satisfactory current stabilization characteristic is obtainable. However, when the CoO amount exceeds 30 weight parts, then the clamping ratio becomes large. Namely, for 2 to 30 parts by weight of CoO the improvement of the clamping ratio is obtainable.

Figure 25:
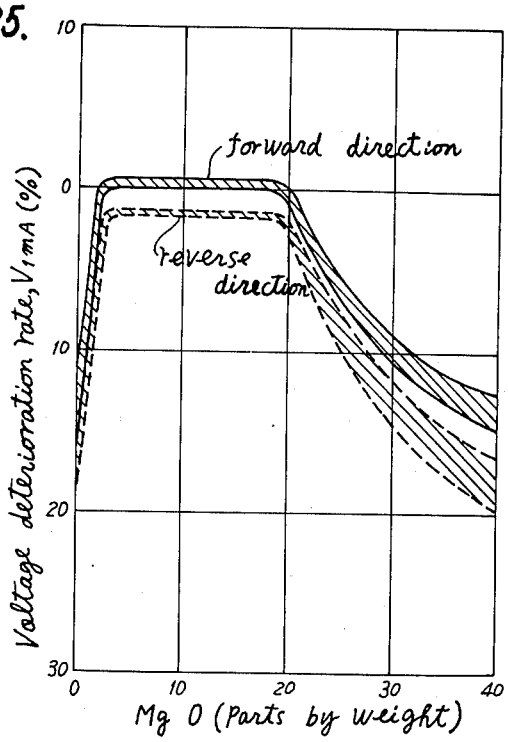

FIG. 25 shows the relation between the amount of MgO in the glass frit and the ratio of deterioration of the voltage across the electrodes after a surge test by many current impulses. The test is conducted by applying 10,000 impulses currents of 50 A (by peak value) of the waveform of the aforementioned $8 \times 20$ μs with 2 second intervals inbetween the pulses in the same direction. As is clear from FIG. 25, for the amount of MgO of over 2 weight parts, the absolute deterioration rates of the voltage $V_{1mA}$ for 1mA current prominently decrease and over 20 weight parts the absolute value of the deterioration rates again increase. As is abovementioned, the amount of 2 to 20 weight parts of MgO is effective in surge life test.

Figure 26:
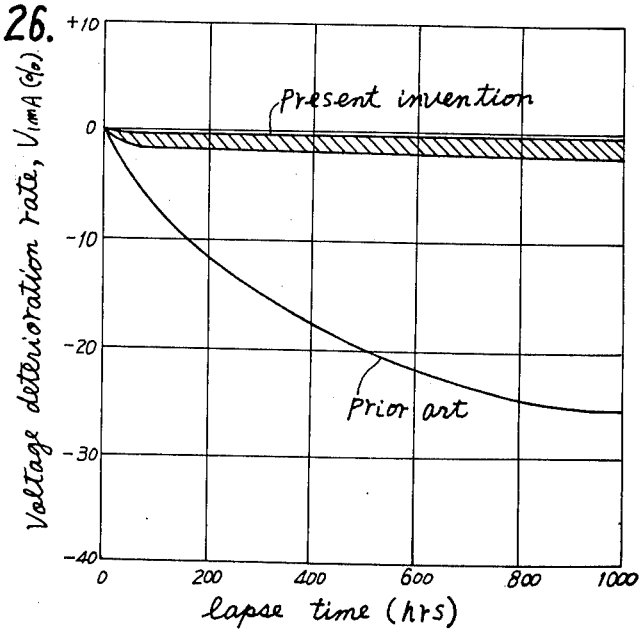

FIG. 26 shows relations between the lapse time from a start of applying A.C. voltage and the deterioration rate of the varistor voltage, of the present example and an example of the prior art. The prior art example is made with he same varistor bulk to the present example, and its electrodes are made by employing the silver paste prepared by the same steps employing the materials of 14 parts by weight of $Ag_2O$ and 30 parts by weight of $B_2O_3$ to 100 parts by weight of the mixture of 85% by weight of $Bi_2O_3$ and 15% by weight of $SiO_2$. The characteristics of the deterioration rates are tested at 70° C by applying A.C. voltage having peak value Vp of $V_{1mA}$, which is the varistor voltage for 1mA current of the varistor. As can be understood from FIG. 26, it is observed that the varistor of the present invention has been drastically improved also for A.C. loading operation. Namely, characteristic of the A.C. operation of the varistor, as well as that of the D.C. operation, is drastically improved, and accordingly, expansion of applications of the varistor can be expected.

Concerning the effects of the amount of $Bi_2O_3$, for less than 80% by weight the deterioration by the impulsive current becomes too large, and for more than 95% by weight the value of the exponent $\alpha$ becomes poor.

Concerning the effect of the $SiO_2$, for less than 5% the value of the exponent $\alpha$ becomes poor, and for more than 20% the voltage resistance of the varistor becomes too high.

Summarizing the example 6, it becomes clear that the silver paste prepared by mixing and kneading silver powder, synthetic resin, solvent and glass frit, which is prepared by mixing 80 to 95% by weight of $Bi_2O_3$ and 5 to 20% by weight of $SiO_2$ adding 1 to 5 parts by weight of $B_2O_3$ 2 to 30 parts by weight of CoO and 2 to 20 parts by weight of MgO, respectively to 100 parts by weight of said mixture, further mixing the above, firing and pulverizing, has great advantage when used in making electrode on zinc oxide type varistor by applying and baking it.

EXAMPLE 7

$Bi_2O_3$ powder, CoO powder, $MnO_2$ powder, $TiO_2$ powder and NiO powder are added to ZnO powder at the rate of 0.01 to 10 mol %, respectively, the above are well mixed and mould into a wafer of 17.5 mm diameter and 1.2 mm thickness. The mould is baked in air at a temperature of 1000° - 1500° C to form a varistor bulk.

Then a glass frit is prepared by mixing 80 - 95% by weight of $Bi_2O_3$, 5 to 20% by weight of $SiO_2$ together, by addding 0 to 20 parts by weight of $B_2O_3$ and 0 to 40 parts by weight of CoO and 0 to 40 parts by weight of $Ag_2O$, respectively, for 100 parts by weight of the above mixture, further mixing and melting the above in an alumina pot at 800 to 1300° C for 30 minutes. Then, the resultant glass is thrown into water for quick cooling and grinding, and the ground glass granule is further pulverized to form the frit.

Then a silver paste is formed by mixing 50 parts by weight of silver (of 0.1 to 10 micron powder diameter), 10 parts by weight of the glass frit, 5 parts by weight of ethylcellulose, 5 parts by weight of n-butyl acetate, 30 parts by weight of butylcarbitol together and sufficiently knead the mixture to obtain a homogeneous pasty composition.

The abovementioned silver paste is applied on both principal faces of the aforementioned varistor bulk by the amount of 20 to 60 mg per each bulk, and the bulk is baked in air at 600° to 900° C for 0.5 to 2 hours.

Characteristics of the varistor made by the abovementioned steps are shown by graphs of FIGS. 27 to 31, wherein hatched region defined between two curves indicates the region within which the characteristic curves vary responding to the changes of the contents of the bulk and the silver paste, amount of the paste applied and conditions of baking within the aforementioned ranges. Namely, even though the conditions vary within the aforementioned ranges, the characteristic curves converge within a considerably narrow hatched ranges.

Figure 27:
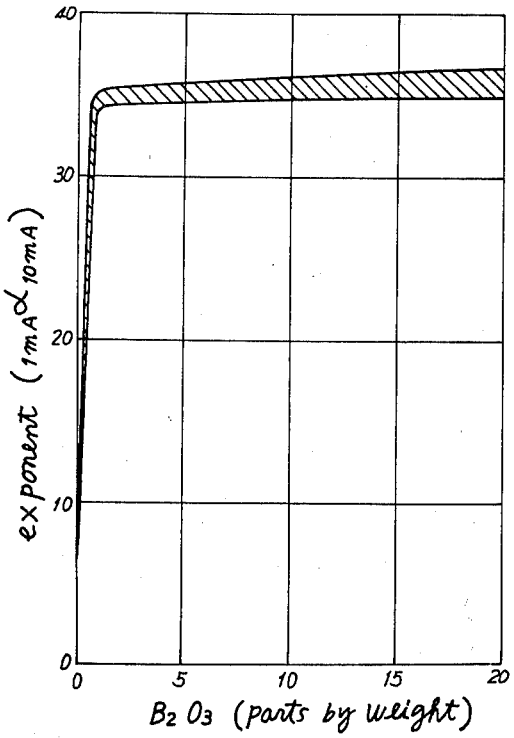

FIG. 27 shows relation between the amount of $B_2O_3$ and the value of exponent $\alpha$. For the amount of $B_2O_3$ of over 1 weight part, the exponent $\alpha$ prominently increases showing superior voltage stabilization characteristic.

Figure 28:
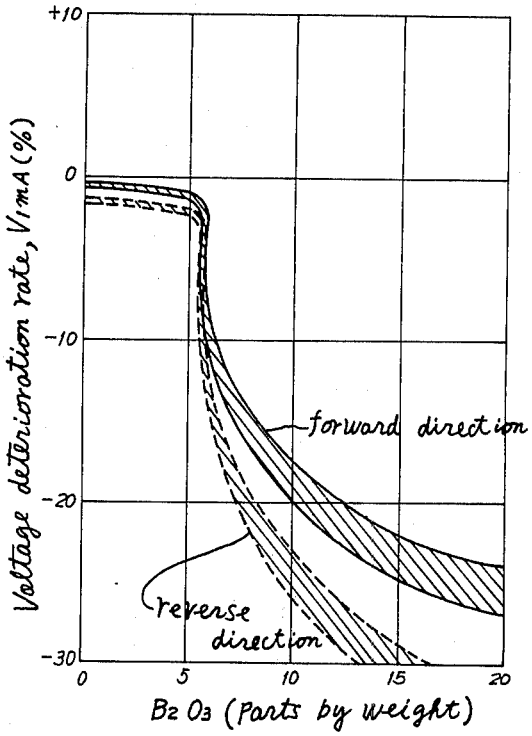

FIG. 28 shows the relation between the amount of $B_2O_3$ in the glass frit and the rate of deterioration of the voltage across the electrodes after a test by large current impulses. The test is conducted by applying two impulse currents of 500A (by peak value) of the waveform of the aforementioned $8 \times 20$ μs in the same direction. As is clear from FIG. 28, for the amount of $B_2O_3$ of over 5 weight parts, both the deterioration rate of the voltage $V_{1mA}$ for 1mA current and difference between the deterioration rates of forward and reverse directions increase, and for over 10 weight parts, the deterioration rates exceed $-10\%$.

Figure 29:
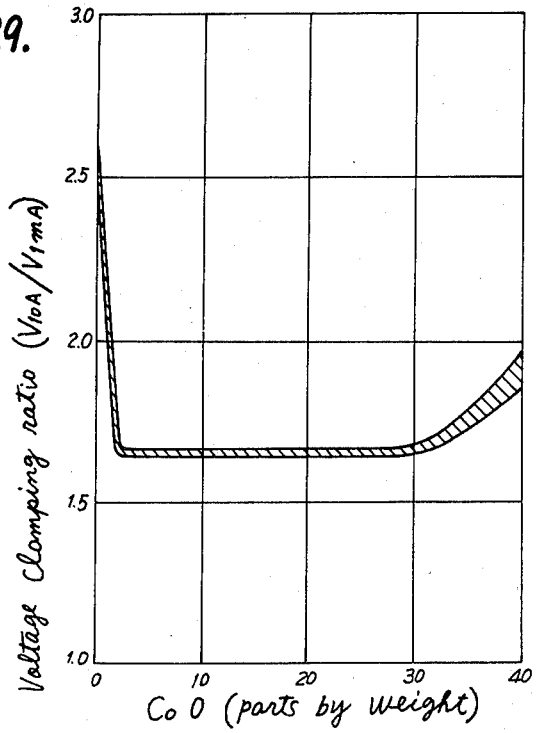

FIG. 29 shows relation between the amounts of CoO in the glass frit and the voltage clamping ratio. The graph shows that for the amount of more than 2 weight part of CoO, the clamping ratio $V_{10A}/V_{1mA}$ becomes small and satisfactory current stabilization characteristic is obtainable. However, when the CoO amount exceeds 30 weight parts, then the clamping rates becomes large. Namely, for 2 to 30 parts by weight of CoO the improvement of the clamping ratio is obtainable.

Figure 30:
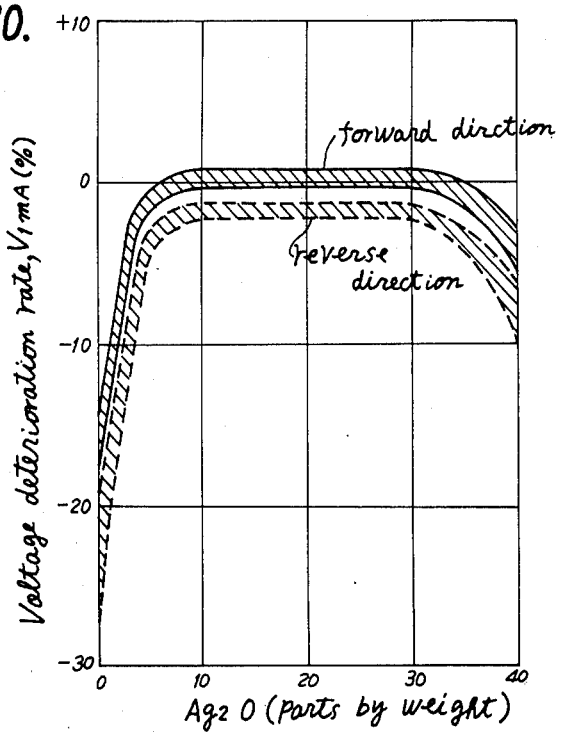

FIG. 30 shows the relation between the amount of $Ag_2O$ in the glass frit and the ratio of deterioration of the voltage across the electrodes after a surge test by many current impulses. The test is conducted by applying 10,000 impulse currents of 50A (by peak value) of the waveform of the aforementioned $8 \times 10$ μs with 2 second intervals inbetween the pulses in the same direction. As is clear from FIG. 30, for the amount of $Ag_2O$ of over 5 weight parts, the absolute deterioration rates of the voltage $V_{1mA}$ for 1mA current prominently decrease and over 35 weight parts the absolute value of the deterioration rates again increase. Besides, for the amount of over 35 weight parts, silver lumps are produced in the frit and therefore making of homogeneous glass frit becomes difficult. As is abovementioned, the amount of 5 to 35 weight parts of $Ag_2O$ is effective in surge life test.

Figure 31:
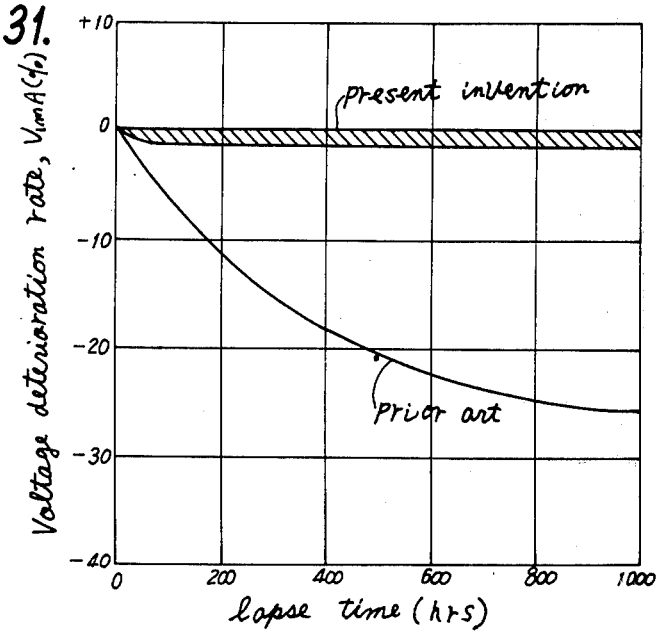

FIG. 31 shows relations between the lapse time from a start of applying A.C. voltage and the deterioration rate of the varistor voltage, of the present example and an example of the prior art. The prior art example is made with the same varistor bulk to the present example, and its electrodes are made by employing the silver paste prepared by the same steps employing the materials of 14 parts by weight of $Ag_2O$ and 30 parts by weight of $B_2O_3$ to 100 parts by weight of the mixture of 85% by weight of $Bi_2O_3$ and 15% by weight of $SiO_2$. The characteristics of the deterioration ratio are tested at 70° C by applying A.C. voltage having peak value Vp of $V_{1mA}$, which is the varistor voltage for 1mA current of the varistor. As can be understood from FIG. 31, it is observed that the varistor of the present invention has been drastically improved also for A.C. loading operation. Namely, characteristic of the A.C. operation of the varistor, as well as that of the D.C. operation, is drastically improved, and accordingly, expansion of applications of the varistor can be expected.

Concerning the effect of the amount of $Bi_2O_3$, for less than 80% by weight the deterioration by the impulsive current becomes too large, and for more than 95% by weight the value of the exponent becomes poor.

Concerning the effect of the $SiO_2$, for less than 5% the value of the exponent becomes poor, and for more than 20% the voltage resistance of the varistor becomes too high.

Summarizing the example 7, it becomes clear that the silver paste prepared by mixing and kneading silver powder, synthetic resin, solvent and glass frit, which is prepared by mixing 80 to 95% by weight of $Bi_2O_3$ and 5 to 20% by weight of $SiO_2$ adding 1 to 5 parts by weight of $B_2O_3$ 2 to 30 parts by weight of CoO and 5 to 35 parts by weight of $Ag_2O$, respectively to 100 parts by weight of said mixture, further mixing the above, firing and pulverizing, has great advantage when used in making electrode on zinc oxide type varistor by applying and baking it.

The following table indicates characteristic data of the abovementioned examples. In the table numbers marked by + represent data measured by voltages of the same direction with that applied for tests, and numbers mark by − represent data measured by voltages of the opposite direction with that applied for test.

Finally, summarizing all of the examples, it becomes clear that silver paste prepared by mixing and kneading silver powder, synthetic resin, solvent and glass frit, which is prepared by mixing 80 to 95% by weight of $Bi_2O_3$ and 5 to 20% by weight of $SiO_2$, adding as additive at least 1 to 5 parts by weight of $B_2O_3$ to 100 parts by weight of said mixture, further mixing the above firing and pulverizing, has great advantage when used in making electrode on zinc oxide type varistor by applying and baking it. It is empirically found that organic contents in the silver paste are decomposed and disappear by the application and baking, but inorganic contents remains substantially unchanged. Therefore, the finished electrodes have the abovementioned contents ratio.

As aforementioned it is also found that even when the amount of the silver varies from 200 to 800 parts by weight to 100 parts by weight of the glass frit, the abovementioned characteristics of the examples are not substantially changed. For the silver amount of below 200 parts the conductivity of the electrodes becomes poor, and for the silver of over 800 parts the electrode layers lose good contact to the varistor bulk.

What is claimed is:

1. A voltage-dependent resistor comprising a bulk consisting mainly of zinc oxide as a major part and, as additives, 0.01 to 10 mol % of $Bi_2O_3$, CoO, MnO, TiO and NiO, respectively and electrodes on said bulk, said electrodes having been formed by baking a silver paste comprising silver powder and a glass frit on said bulk, said glass frit containing as its principal contents 80 to 95% by weight of $Bi_2O_3$ and correspondingly 20 to 5% by weight of $SiO_2$ said glass frit also containing 1 to 5 parts by weight of $B_2O_3$ per 100 parts of said principal contents.

2. A voltage-dependent resistor according to claim 1 wherein said glass frit also contains 2 to 30 parts by weight of CoO per 100 parts by weight of total $Bi_2O_3$ and $SiO_2$.

3. A voltage-dependent resistor according to claim 1 wherein said glass frit also contains 2 to 30 parts by weight of $Sb_2O_3$ per 100 parts by weight of total $Bi_2O_3$ and $SiO_2$.

4. A voltage-dependent resistor according to claim 1 wherein said glass frit also contains 2 to 30 parts by weight of $Sb_2O_3$ and 5 to 35 parts by weight of $Ag_2O$ per 100 parts by weight of total $Bi_2O_3$ and $SiO_2$.

5. A voltage-dependent resistor according to claim 1 wherein said glass frit also contains 2 to 30 parts by weight of $Sb_2O_3$ and 2 to 20 parts by weight of MgO per 100 parts by weight of total $Bi_2O_3$ and $SiO_2$.

6. A voltage-dependent resistor according to claim 1 wherein said glass frit also contains 2 to 30 parts by weight of CoO and 2 to 20 parts by weight of MgO per 100 parts by weight of total $Bi_2O_3$ and $SiO_2$.

7. A voltage-dependent resistor according to claim 1 wherein said glass frit also contains 2 to 30 parts by weight of CoO and 5 to 35 parts by weight of $Ag_2O$ per 100 parts by weight of total $Bi_2O_3$ and $SiO_2$.

8. A voltage-dependent resistor according to claim 1 wherein the silver powder is from 200 to 800 parts by weight per 100 parts by weight of glass frit.

9. A method of making a voltage-dependent resistor comprising the steps of mixing 80 to 95% by weight of $Bi_2O_3$ powder and 5 to 20% by weight of $SiO_2$ powder to form a mixture, adding 1 to 5 parts by weight of $B_2O_3$ to 100 parts by weight of said mixture as an additive, further mixing said mixture and additive, firing them and pulverizing the fired mixture to form a glass frit, mixing the glass frit, silver powder, synthetic resin and solvent together and kneading to form a silver paste, applying said silver paste to form coatings on both principal faces of a varistor bulk which consists mainly of zinc oxide as a major part and, as additives, 0.01 to 10 mol % of $Bi_2O_3$, CoO, $MnO_2$, $TiO_2$ and NiO, respectively, and baking the varistor bulk with said coatings.

10. The method of claim 9 wherein the making said glass frit there is also employed 2 to 30 parts by weight of CoO per 100 parts by weight of total $Bi_2O_3$ and $SiO_2$.

11. The method of claim 9 wherein in making said glass frit there is also employed 2 to 30 parts by weight of $Sb_2O_3$ per 100 parts by weight of total $Bi_2O_3$ and $SiO_2$.

12. The method of claim 9 wherein in making said glass frit there is also employed 2 to 30 parts by weight of $Sb_2O_3$ and 5 to 35 parts by weight of $Ag_2O$ per 100 parts by weight of total $Bi_2O_3$ and $SiO_2$.

13. The method of claim 9 wherein in making said glass frit there is also employed 2 to 30 parts by weight of $Sb_2O_3$ and 2 to 20 parts by weight of MgO per 100 parts by weight of total $Bi_2O_3$ and $SiO_2$.

14. The method of claim 9 wherein in making said glass frit there is also employed 2 to 30 parts by weight of CoO and 2 to 20 parts by weight of MgO per 100 parts by weight of total $Bi_2O_3$ and $SiO_2$.

15. The method of claim 9 wherein in making said glass frit there is also employed 2 to 30 parts by weight of CoO and 5 to 35 parts by weight of $Ag_2O$ per 100 parts by weight of total $Bi_2O_3$ and $SiO_2$.

16. The method of claim 9 wherein the silver powder employed is from 200 to 800 parts by weight per 100 parts by weight of glass frit forming material.

* * * * *

UNITED STATES PATENT OFFICE

CERTIFICATE OF CORRECTION

Patent No. 4,060,661 Dated Nov. 29, 1977

Inventor(s) Akihiro TAKAMI, Takayuki KURODA, Katsuo NAGANO and Michio MATSUOKA

It is certified that error appears in the above-identified patent and that said Letters Patent are hereby corrected as shown below:

[30] Foreign Application Priority Data

August 22, 1975 Japan ..... 50-102449

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*